US006890268B1

(12) United States Patent
Strand et al.

(10) Patent No.: US 6,890,268 B1
(45) Date of Patent: May 10, 2005

(54) GOLF PUTTER TRAINING APPARATUS

(75) Inventors: Allan M. Strand, Laguna Niguel, CA (US); Phillip Downey, La Verne, CA (US)

(73) Assignee: Dandy Golf, Riverside, CA (US)

( * ) Notice: Subject to any disclaimer, the term of this patent is extended or adjusted under 35 U.S.C. 154(b) by 0 days.

(21) Appl. No.: 10/763,743

(22) Filed: Jan. 23, 2004

Related U.S. Application Data

(60) Provisional application No. 60/442,131, filed on Jan. 23, 2003.

(51) Int. Cl.[7] ..... A63B 69/36
(52) U.S. Cl. ..... 473/261; 473/219; 473/258; 211/70.2
(58) Field of Search ..... 473/219, 223, 473/226, 229, 257, 258, 260, 261, 262, 263, 473/264, 265; 273/DIG. 30

(56) References Cited

U.S. PATENT DOCUMENTS 2,435,893 A * 2/1948 Mall ..... 206/315.2
2,590,154 A * 3/1952 Burns ..... 280/47.19
3,844,569 A * 10/1974 Swanson ..... 473/231
5,393,065 A * 2/1995 LeQuyea ..... 473/260
5,797,804 A * 8/1998 Chen ..... 473/260
6,695,709 B1 * 2/2004 Ottensmeyer ..... 473/258

* cited by examiner

*Primary Examiner*—Gregory Vidovich
*Assistant Examiner*—Nini F. Legesse
(74) *Attorney, Agent, or Firm*—Haugen Law Firm PLLP

(57) ABSTRACT

A golf club training apparatus for use in operable combination with a golf club includes an alignment device having a golf club head receiving structure formed of a base portion having a front edge, a rear edge, and first and second side edges, as well as a rear wall extending upwardly from the rear edge, first and second side walls extending upwardly from the first and second side edges, respectively, and front retaining tabs extending upwardly from the front edge of the base portion. The rear wall, the first and second side walls, the front retaining tabs, and the base portion, in combination, are sized and configured to operably receive and frictionally retain a head element of the golf club therebetween. The golf club head receiving structure is configured to solely operably maintain the golf club in an upright playing position when the alignment device is operably disposed on a substantially horizontal surface.

4 Claims, 2 Drawing Sheets

GOLF PUTTER TRAINING APPARATUS

CROSS-REFERENCE TO RELATED APPLICATIONS

This application claims priority from U.S. Provisional Patent Application Ser. No. 60/442,131, filed Jan. 23, 2003 and entitled "GOLF PUTTER TRAINING APPARATUS", the content of which is incorporated herein in its entirety.

FIELD OF THE INVENTION

The present invention relates to golf club aids generally, and more particularly to a golf putter training apparatus incorporating a putter alignment device.

BACKGROUND OF THE INVENTION

Golf training aids are widely available in a variety of configurations, each being adapted for specific training purposes for certain aspects of the game of golf. Such training aids in use today, however, typically require the contemporaneous participation by the user to effectuate the teaching purpose of the respective golf training aid. Such a requirement limits the degree of instant visual training that can be most helpful in immediately identifying certain flaws in the user's positioning, swing, or the like.

It is therefore a principal object of the present invention to provide a golf training aid that allows the user to utilize the apparatus without contemporaneous participation therewith.

It is a further object of the present invention to provide a golf training aid that itself supports a golf club in a proper upright playing position without assistance from additional external sources.

It is a still further object of the present invention to provide a golf training aid that is configured for operably retaining a golf club head therein in such a manner so as to support the golf club in an upright playing position without assistance from the user.

It is another object of the present invention to provide a golf training aid which itself supports a golf putter in an upright playing position without assistance from the user.

SUMMARY OF THE INVENTION

By means of the present invention, a golf club training aid is provided for operably engaging a golf club head in a manner so as to maintain the golf club in a correct upright playing position without assistance from the user. The golf training aid removably engages with the golf club head, and is configured to support the weight of the golf club in an upright playing position.

In a particular embodiment of the present invention, the golf club training apparatus includes an alignment device having a golf club head receiving structure which itself includes a base portion having a front edge, a rear edge, and first and second side edges. The golf club head receiving structure further includes a rear wall extending upwardly from the rear edge, first and second side walls extending upwardly from the first and second side edges, respectively, and front retaining tabs extending upwardly from the front edge of the base portion. The rear wall, the first and second side walls, the front retaining tabs, and base portion, in combination, are specifically sized and configured to operably receive and frictionally retain a head element of the golf club therebetween to solely operably maintain the golf club in an upright playing position when the alignment device is operably disposed on a substantially horizontal surface. Preferably, the front retaining tabs are spaced apart from one another across a central region of the front edge of the base portion, such that a dimension between the front retaining tabs at the central region is at least 1.75 inches.

In some embodiments of the present invention, the alignment device includes first and second platform portions extending outwardly from the first and second side edges of the base portion and in a plane parallel to at least a portion of the base portion. The platform portions are configured to operably stabilize the alignment device in maintaining in an upright playing position.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
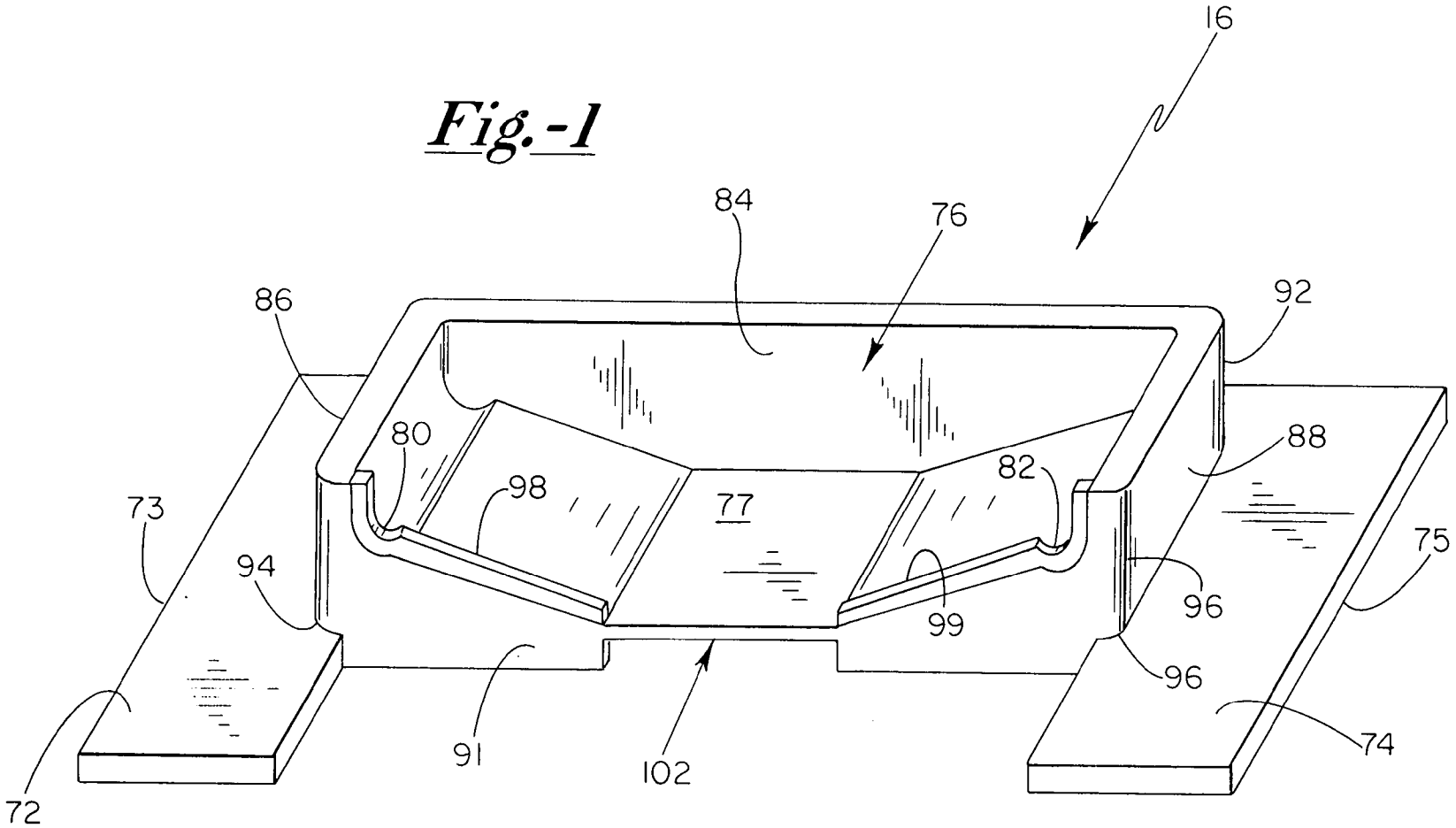
FIG. 1 is a perspective view of a golf club training apparatus of the present invention.

Referring now by characters of reference to the drawings, and first to FIG. 1, a golf club alignment device 16 is shown having a golf club head receiving portion 76 that is defined by a base portion 77 having a front edge 91, a rear edge 92, and first and second side edges 94, 96. Golf club head receiving portion 76 preferably further includes a rear wall 84 extending upwardly from rear edge 92, first and second side walls 86, 88 extending upwardly from first and second side edges 94, 96, and front retaining tabs 98, 99 extending upwardly from front edge 91 of base portion 77.

Figure 2:
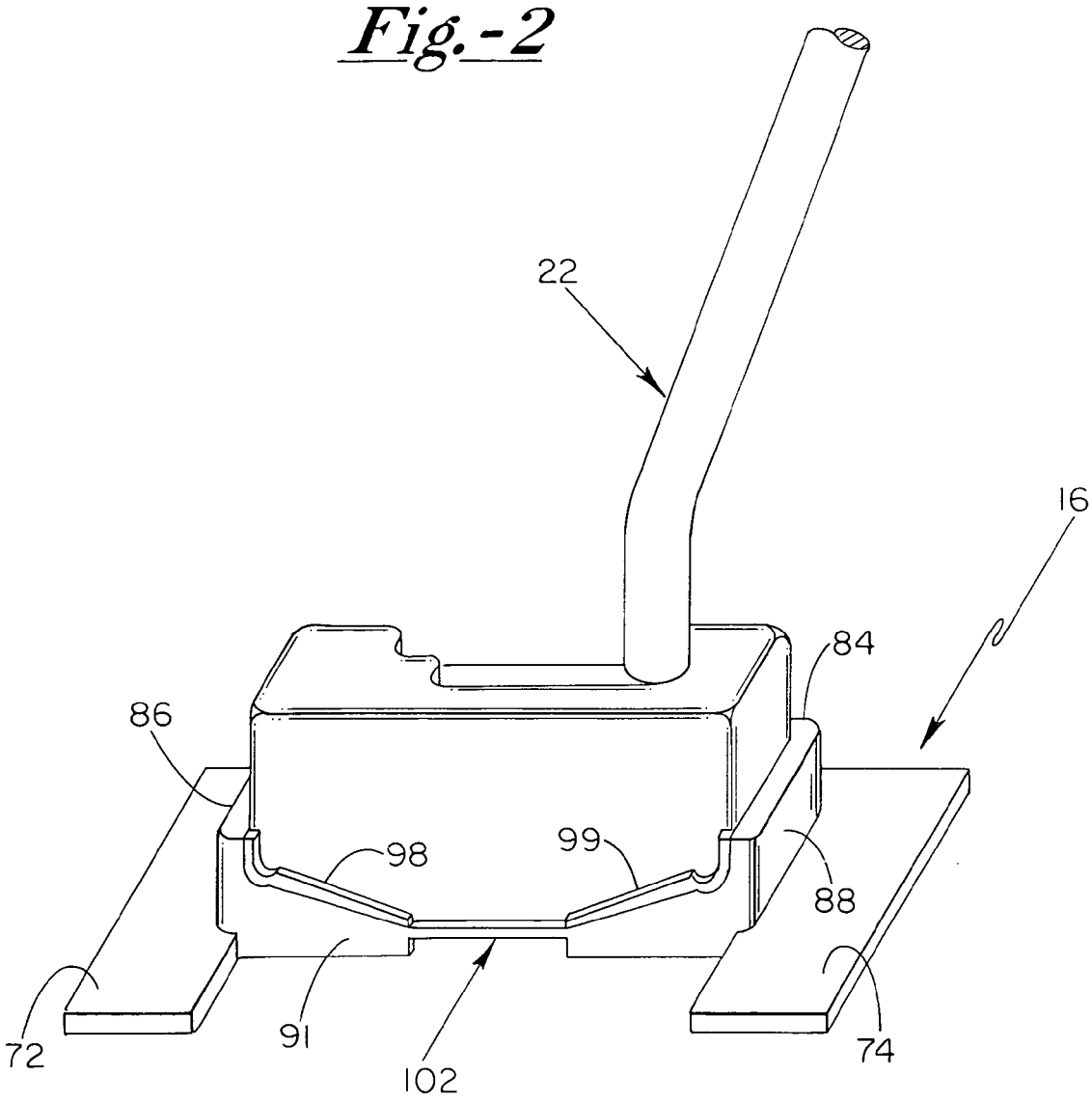
FIG. 2 is perspective view of a golf club that is operably engaged with the golf club training apparatus illustrated in FIG. 1.

As shown in FIG. 2, receiving portion 76 is preferably sized and configured to matingly and removably engage with a golf club head. Such mating engagement is preferably a tight fit so that the golf club head is frictionally retained in alignment device 16.

Preferably, receiving portion 76 is specifically configured to matingly engage with a particular putter head so that the highest possible degree of fit between receiving portion 76 and the putter head may be achieved. In other embodiments, however, insert portions (not shown) may be incorporated into receiving portion 76 so that various golf clubs 22 may be utilized with alignment device 16 of the present invention. Receiving portion 76 preferably includes concave portions 80, 82 for assisting in retaining the putter head within receiving portion 76.

In operation, at least a portion of the golf club head is matingly engaged in receiving portion 76, such that the backside of the golf club head is adjacent to, and in facing relationship with rear wall 84 of receiving portion 76. Thus, the ball-striking surface of the golf club head is exposed between front retaining tabs 98, 99 extending upwardly from front edge 91 of base portion 77 when the club head is engaged in receiving portion 76 of alignment device 16.

Front retaining tabs 98, 99 of receiving portion 76 are preferably spaced from central region 102 of front edge 91 of base portion 77 in order to expose at least a portion of a front face of the golf club head engaged with alignment device 16. Preferably, front retaining tabs 98, 99 are spaced apart a distance of at least 1.75 inches so as to provide for an exposed club face area that is larger than the diameter of a regulation golf ball. In such a manner, golf club 22 may be utilized to hit golf balls while alignment device 16 is operably coupled thereto. Sidewalls 86, 88 are preferably substantially rigid, but may display a degree of flexibility to desirably retain the club head in receiving portion 76.

Alignment device 16 is preferably easily and removably attachable to club 22 so that alignment device 16 may be selectively used as desired. Alignment device 16 is also preferably sized and weighted so that a conventional golf club 22, and most preferably a golf putter, is able to stand upright in a proper playing position while connected thereto. Such functionality is accomplished through the overall symmetrical design and weighting of alignment device 16. Therefore, stand device 16 may be used as an aid for standing golf putters freely in an upright playing position.

Alignment device 16 may therefore be used as a training aid to assist a user in observing a proper club face alignment from afar without having to contemporaneously handle the club. In addition, alignment device 16 may be utilized in combination with a golf putter in order to develop a correct putting swing. In particular, alignment device 16 preferably further includes first and second platform portions 72, 74 extending outwardly from first and second side edges 94, 96 of base portion 77 and in a plane parallel to at least a portion of base portion 77. Preferably, first and second platform portions 72, 74 are integrally formed with receiving portion 76, such that alignment device 16 is preferably a single unit integrally formed. Accordingly, first and second platform portions 72, 74 assist in maintaining the club head in a substantially horizontal orientation throughout the portion of the swing path adjacent to the ground surface. In addition, receiving portion 76 may be specifically configured for a particular golf putter design, such that the most correct upright putter orientation is maintained by alignment device 16. Moreover, alignment device 16 is preferably weighted and balanced in symmetry so as to maintain the designed balance of the corresponding putter.

Alignment device 16 is further assisted by first and second platform portions 72, 74 in maintaining the operably attached golf club 22 in an upright playing position by providing a wider stance that is spaced from the center of gravity of alignment device 16. Though first and second platform portions 72, 74 are illustrated as being formed in a plane containing base portion 77, such first and second platform portions 72, 74 may be displaced upwardly or downwardly with respect to base portion 77, as desired, so long as such platform portions 72, 74 provide added surface area for stabilizing club 22 in a proper upright playing position.

In particularly preferred embodiments of the present invention, alignment device 16 is formed from a transparent material so as to minimize visual distraction of the user. Alignment device 16 is preferably fabricated from a lightweight and durable material, such as various polymeric materials.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A golf club training apparatus for use in operable combination with a golf club, said training apparatus comprising:

an alignment device having a golf club head receiving means including a base portion having a front edge, a rear edge, and first and second side edges, said golf club head receiving means further including a rear wall extending upwardly from said rear edge, first and second side walls extending upwardly from said first and second side edges, respectively, and front retaining tabs extending upwardly from said front edge of said base portion, said rear wall, said first and second side walls, said front retaining tabs, and said base portion, in combination, being sized and configured to operably receive and frictionally retain a head element of said golf club therebetween, said golf club head receiving means being further configured to solely operably maintain said golf club in an upright playing position when said alignment device is operably disposed on a substantially horizontal surface.

2. A golf club training apparatus as in claim 1 wherein said front retaining tabs are spaced apart from one another across a central region of said front edge of said base portion, such that the dimension between said front retaining tabs at said central region is at least 1.75 inches.

3. A golf club training apparatus as in claim 1, including first and second platform portions extending outwardly from said first and second side edges of said base portion and in a plane parallel to at least a portion of said base portion, said platform portions being configured to operably stabilize said alignment device in maintaining said golf club in an upright playing position.

4. A golf club training apparatus as in claim 1 wherein said golf club is a putter.

* * * * *